United States Patent [19]

Bates

[11] 4,112,538

[45] Sep. 12, 1978

[54] CARPET CLEANING MACHINE

[76] Inventor: Jack A. Bates, 2530 Fishinger, Columbus, Ohio 43221

[21] Appl. No.: 665,268

[22] Filed: Mar. 9, 1976

Related U.S. Application Data

[63] Continuation-in-part of Ser. No. 471,508, May 20, 1974, Pat. No. 3,942,217, which is a continuation of Ser. No. 260,586, Jun. 7, 1972, abandoned.

[51] Int. Cl.[2] ..... A47L 7/00

[52] U.S. Cl. ..... 15/321; 15/353

[58] Field of Search ..... 15/320, 321, 353

[56] References Cited

U.S. PATENT DOCUMENTS

| | | | |
|---|---|---|---|
| 3,496,592 | 2/1970 | Jones | 15/321 |
| 3,694,263 | 9/1972 | Korn, Sr. | 15/321 X |
| 3,705,437 | 12/1972 | Rukavina, Jr. et al. | 15/302 |
| 3,747,155 | 7/1973 | Koellisch | 15/321 X |
| 3,818,537 | 6/1974 | Evans | 15/321 |
| 3,828,390 | 8/1974 | Cater | 15/321 |
| 3,902,219 | 9/1975 | Jones | 15/321 X |

*Primary Examiner*—Christopher K. Moore

[57] ABSTRACT

A carpet cleaning machine of the portable type that is characterized by a compact frame arrangement for supporting dispensing and pick-up systems for liquid type carpet cleaners. The cleaning liquid and dirty liquid are simultaneously applied to and picked up from a carpet by means of a manually operated carpet cleaning tool. The machine is further characterized by auxiliary dirty fluid collecting means mounted on a separate wheeled auxiliary frame. The auxiliary fluid collecting means is disconnectably located in the flow of dirty fluid from the carpet cleaning tool to a main collecting means on the machine with said auxiliary collecting means being adapted to be removed from emptying without preventing continuation of the carpet cleaning operation. The machine is further characterized by a novel dispensing system for a solution of hot water and cleaning fluid which includes a holding tank and associated control valve means for automatically controlling the supply of cleaning solution available to the carpet cleaning tool.

8 Claims, 6 Drawing Figures

CARPET CLEANING MACHINE

REFERENCE TO CO-PENDING APPLICATION

This application is a continuation in-part of my co-pending application Ser. No. 471,508 filed May 20, 1974, now U.S. Pat. No. 3,942,217 issued Mar. 9, 1976, which is a continuation of application Ser. No. 260,586 filed June 7, 1972, now abandoned.

BACKGROUND OF THE INVENTION

This invention relates to carpet cleaning machines, and more particularly to a portable carpet cleaning apparatus with a novel dispensing and pick-up system for liquid type cleaning materials.

SUMMARY OF THE INVENTION

In general, the carpet cleaning machine of the present invention includes a main frame means provided with wheels which support a hydraulic dispensing system for cleaning liquid and a pneumatic pick-up system for the liquid after it has been applied to a rug, with said systems being operated simultaneously for continuous rug cleaning operations.

In accordance with the present invention the pneumatic pick-up system for the dirty cleaning fluid comprises a main dirty fluid collecting means moulded on said main frame means and connected to an auxiliary dirty fluid collecting means mounted on a separate auxiliary frame means. The dirty fluid picked up from the carpet first passes into said auxiliary collecting means, which when full, can be detached from the system and transported on its own auxiliary wheeled frame to a disposal location. At the same time the main collecting means remains operative in the system such that one of two operators can continue the rug cleaning while the other takes the auxiliary collecting means to the disposal location.

It is another object of the present invention to provide a carpet cleaning machine of the type described which includes a holding tank for a heated solution of cleaning fluid and water which tank is provided with an automatically controlled valve means for maintaining a supply of mixed hot water and soap solution with such valve being responsive to the demand imposed by the release of fluid from the cleaning tool.

It is another object of the present invention to provide an apparatus of the type described wherein the holding tank means automatically maintains a supply of heated cleaning solution when the machine is transferred from one job to another such that the machine is ready for immediate use.

As another object of the present invention, the novel carpet cleaning machine comprises a unique upright frame configuration wherein the collecting means and dispensing reservoirs are compactly mounted on the upper portion of the frame means, with the other components of the dispensing and pick-up systems being compactly mounted on the frame means below said reservoirs. This provides a machine that can be moved about in confined carpeted areas, as well as one that can readily be moved up and down stairs or loaded on a vehicle bed.

As another object of the present invention, the carpet cleaning machine includes a novel arrangement of a collecting means and reservoir wherein a dirty fluid collecting means is compactly mounted within a clean fluid dispensing reservoir in isolated relationship therewith.

As still another object of the present invention the carpet cleaning machine comprises novel auxiliary collecting means and wheeled frame means wherein the collecting means is pivotally mounted on said frame means so as to be tiltable to facilitate emptying of the collected dirty fluid.

As still another object of the present invention the carpet cleaning machine comprises a novel upright main frame arrangement provided with an endless loading belt apparatus on the upper portion thereof which loading apparatus facilitates loading of the machine on a truck bed or the like.

Further objects and advantages of the present invention will be apparent from the following description, reference being had to the accompanying drawings wherein a preferred form of embodiment of the invention is clearly shown.

DESCRIPTION OF THE PREFERRED EMBODIMENT

Figure 1:
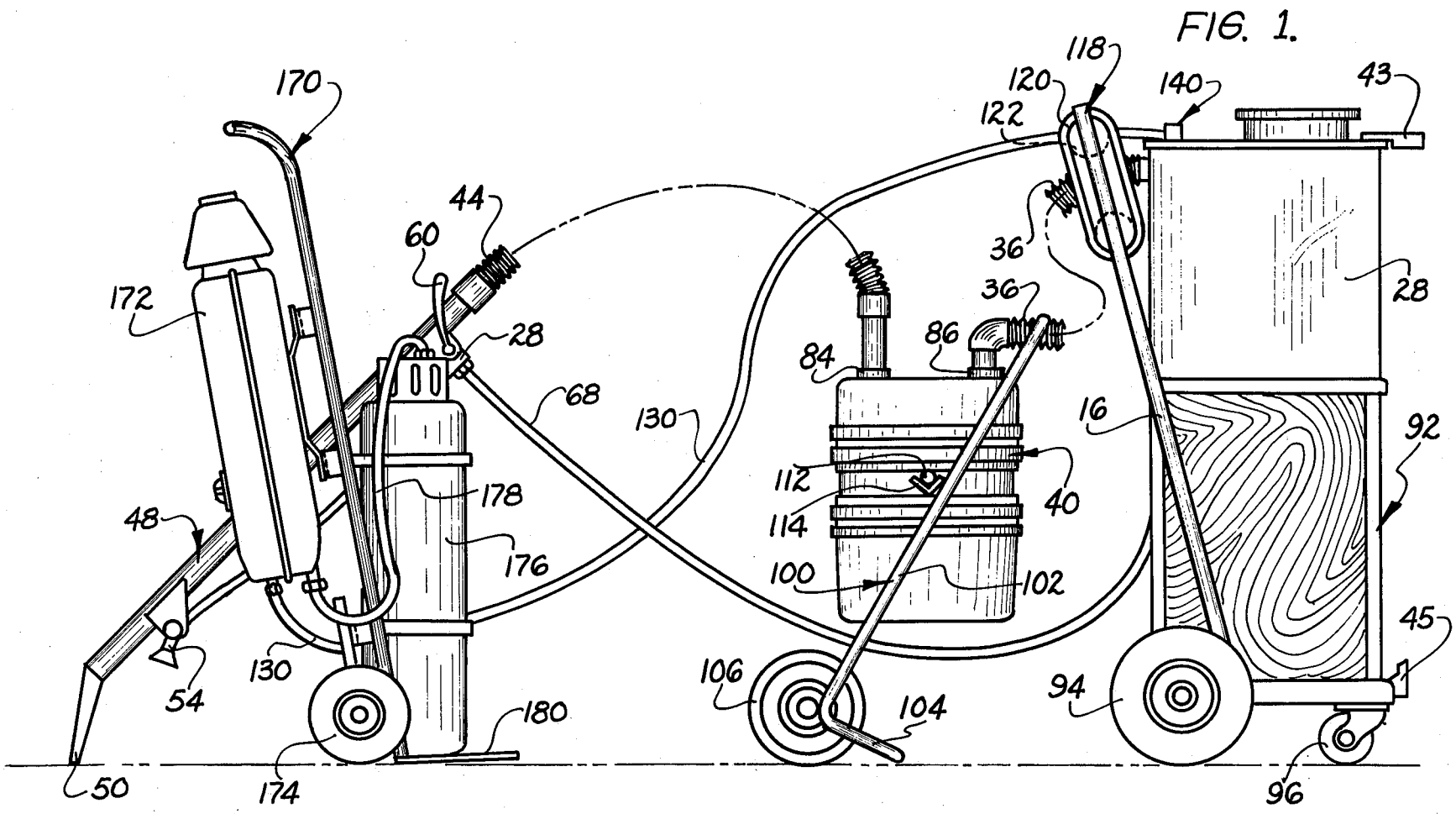
FIG. 1 is a side elevational view of the carpet cleaning machine constructed in accordance with the present invention.
Figure 2:
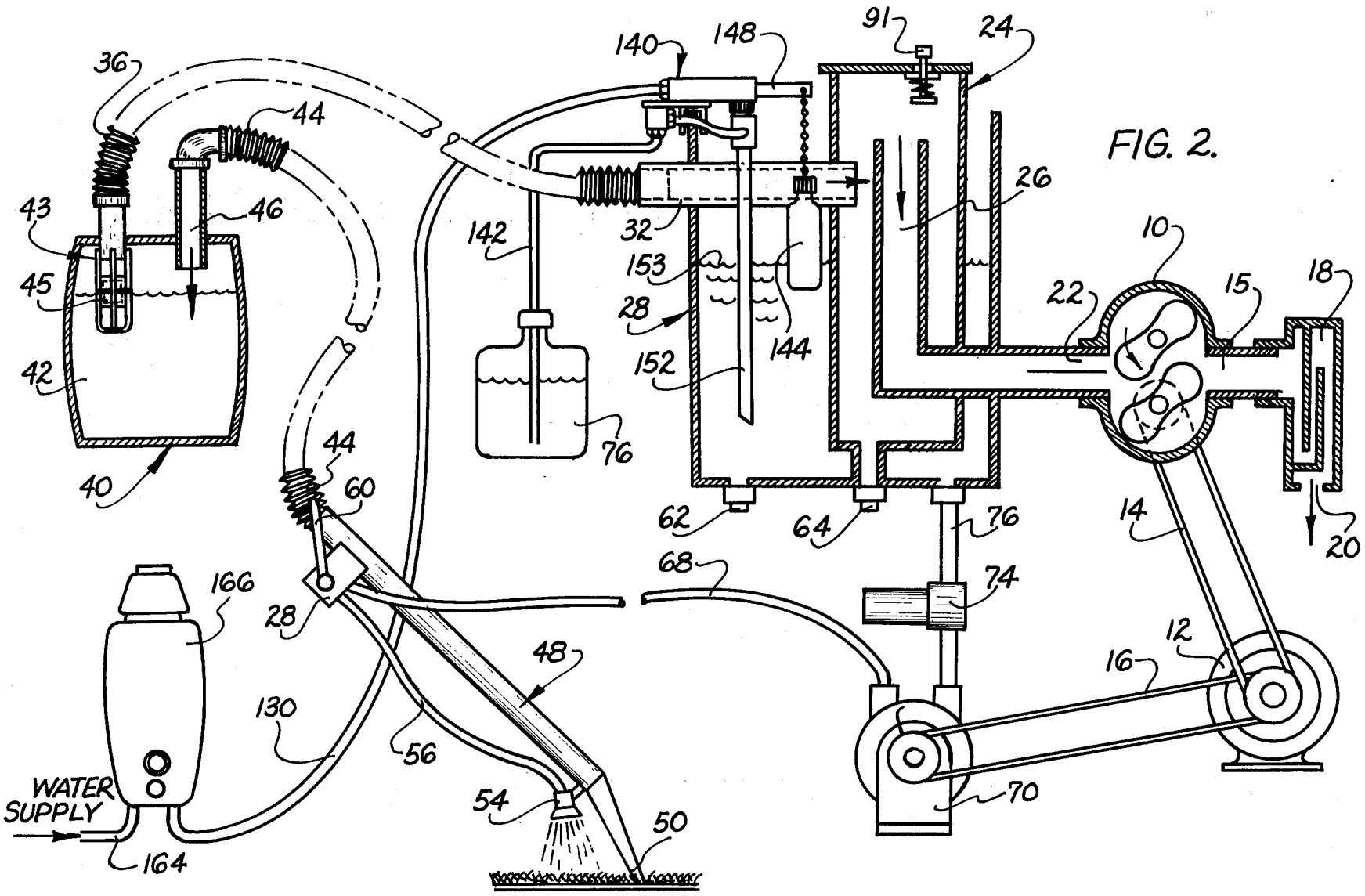
FIG. 2 is a diagrammatic view illustrating the fluid dispensing and fluid collecting systems of the machine of FIG. 1.
Figure 5:
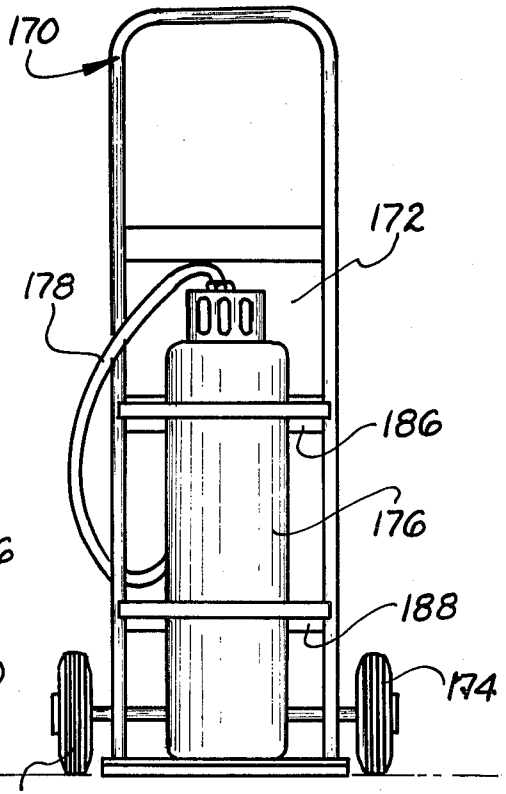
FIG. 5 is a rear elevational view corresponding to FIG. 3.
Figure 4:
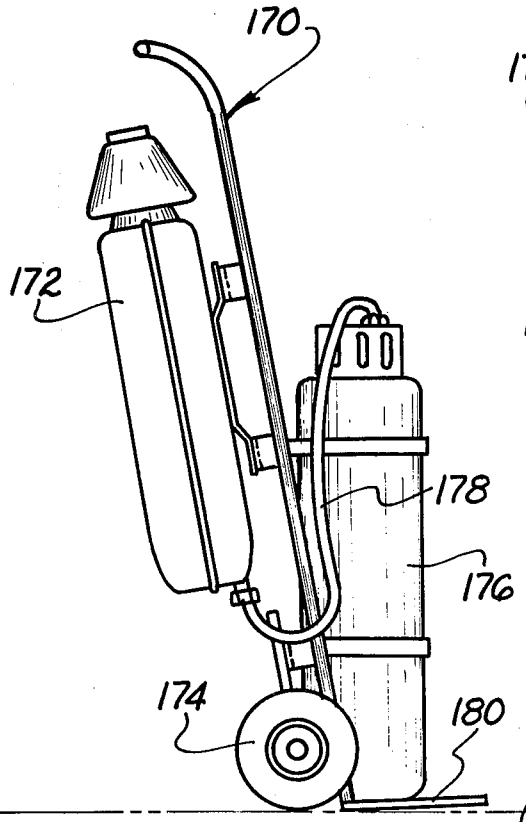
FIG. 4 is a side elevational view corresponding to FIG. 3.
Figure 3:
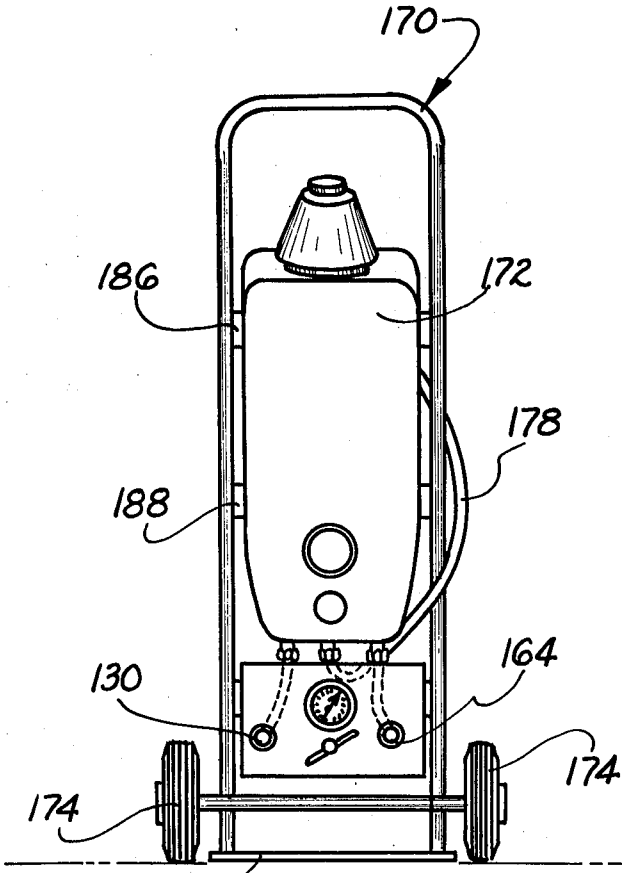
FIG. 3 is a front elevational view of a hot water supply apparatus comprising a portion of the machine of FIG. 1.

Referring to FIGS. 1 and 2, the machine of the present invention comprises a main frame 92 that supports a holding tank 28 for a solution of cleaning fluid and hot water. A main dirty fluid collecting means 24 is mounted within dispensing reservoir 28 in isolated relationship therewith as is best seen in FIG. 2.

A manipulatable carpet cleaning tool is indicated generally at 48 and includes a dirty fluid pick-up opening 50 that is moved along the carpet by the operator. Suction is provided at inlet opening 50 by a blower 10 which includes a blower inlet 22 that sucks air from tool inlet 50 through the handle, a flexible hose 44, and auxiliary collecting means 40, a flexible hose 36, a horizontal tube 32, the interior of a secondary dirty fluid collecting means 24, and L-shaped tube 26 communicating with the blower inlet 22.

As is best seen in FIG. 2, air is discharged from the outlet of blower 10 via pipe 15 and muffler trap 18 to the environment at 20.

It should be mentioned that the dirty fluid is deposited in dirty bath 42 of auxiliary collecting means 40 until such collecting means fills to the level of a float actuated shut-off valve 43 which includes a float 45. The auxiliary collecting means 40 can be disconnected and the carpet cleaning tool connected directly to horizontal pipe 32 via couplings 84 and 86 so as to continue operation of the machine while the auxiliary collecting means is being transported and emptied.

It should be mentioned that secondary collecting means 24 is provided with a vacuum relief valve 91 mounted in a lid 90 thereof so as to admit ambient air at some predetermined pressure setting of vacuum relief valve 91.

It should further be mentioned that carpet cleaning tool 48 can conveniently be stored on the machine by placing the lower pick-up opening 50 on the base means behind a retaining bracket 45 and by also removably inserting the upper portion of the carpet cleaning tool 48 into a resilient bracket 43 formed of synthetic rubber or the like that permits the carpet cleaning tool to be attached to the machine.

It will now be understood that when the operator opens control valve 60, a spray 80 of cleaning fluid will be delivered directly to carpet 52.

A motor 12 is mounted on the frame means beneath the cleaning fluid reservoir and main collecting means and arranged to drive blower 10 by a flexible belt 14, as well as pump 70 by a flexible belt 16.

It should be mentioned that main frame 92 is provided with spaced rear wheels 94 and a front caster wheel 96 as well as with upright handle members 16 which permit manipulation of the machine within confined carpeted areas such as hallways or the like.

With further reference to main frame 92, the upper portion of handle means 116 includes a rotary loading means 118 in the form of an endless rubber belt 120 mounted on pulleys 122. Such loading means 118 greatly facilitates the mounting of the machine on a truck bed merely by tilting the machine until the belt 120 engages the end of the truck bed and by further lifting the lower end of the machine to a horizontal position wherein it can be rolled back onto the truck bed.

It should be mentioned that drains 62 and 64 are provided for cleaning fluid reservoir 28 and main collecting means 24.

With reference to FIG. 1, auxiliary frame 100 includes a generally tubular frame comprising a supporting base 104 provided with spaced front wheels 106 for transporting the auxiliary frame 100 when tilted and wheeled. Inclined tubular handle members 102 each includes a cradle 114 that pivotally supports bearing rods 112.

Referring again to FIG. 2, a holding tank is indicated generally at 28 for a heated solution of cleaning fluid and water.

Cold water from a pressurized supply such as a household tank passes via line 164 to the inlet of a hot water heater 172 and then through line 130 to the water inlet of an on-off valve 140.

Figure 6:
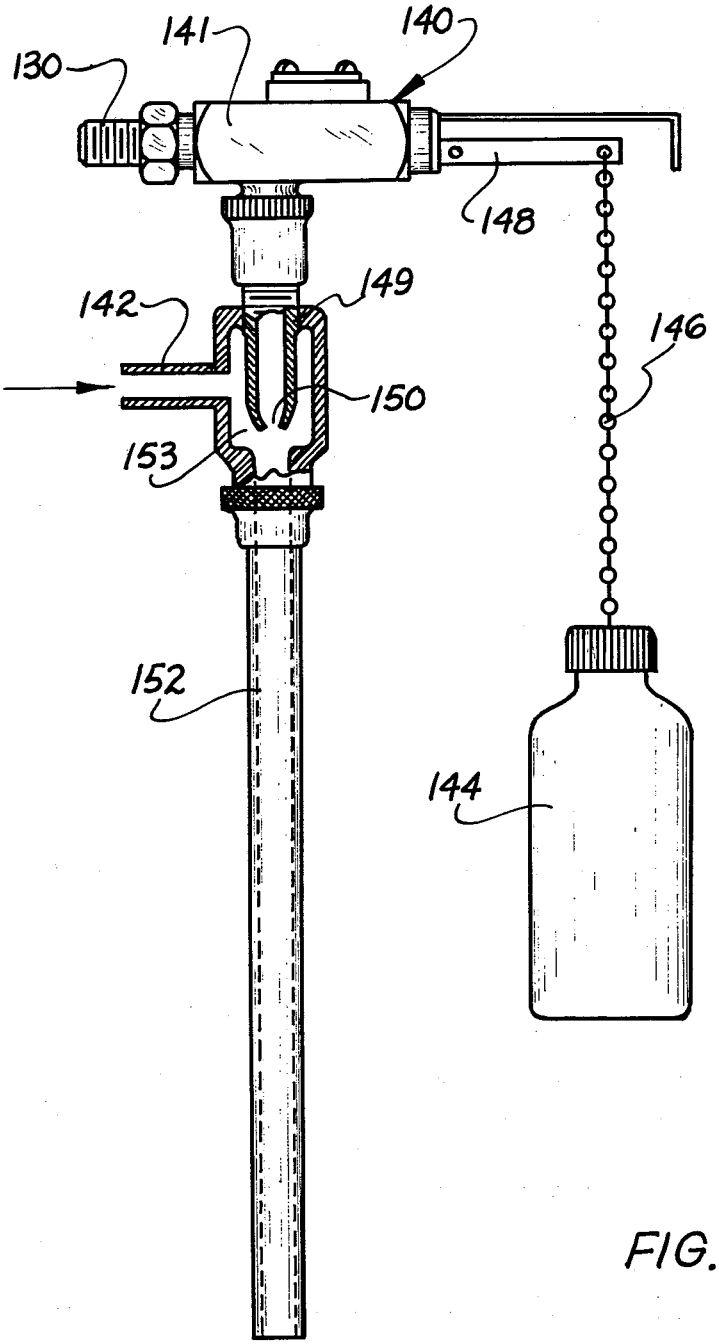
FIG. 6 is a side elevational view partially in section of a control valve means comprising a portion of the fluid dispensing system of the machine of the preceding figures.

FIG. 6 is an enlarged view of valve 140 which includes a housing 141 that encloses a snap-action on-off valve for connecting the inlet line 130 with the tube 149 that includes a venturi orifice 150.

As seen in FIG. 6, the valve elements in housing 141, which include a seat and movable enclosure, not illustrated, are actuated by an arm 148 that is connected to a float 144 by a chain 146. When the solution level 153 in holding tank 28 rises to a pre-selected level, then float 144 releases valve arm 148 for upward movement with said arm being biased upwardly by an internal spring. Upon upward movement of arm 148, then the hot water control valve 140 is closed.

Upon operation of the tool 48, heated solution is delivered to the tool outlet 54 via line 76, valve 74, pump 70, line 68, and line 56.

It should be mentioned that the system of FIG. 2 further includes a cleaning fluid reservoir 76 which is connected to an annular chamber 153 via soap delivery line 142 such that upon the discharge of pressurized water from vent orifice 150 a suction is created in chamber 153 and line 142 which draws cleaning fluid from reservoir 76 and adds it to the incoming water from line 130 thereby providing a heated solution of cleaning fluid and water in the outlet line 152 leading from the outlet of the venturi chamber.

In operation, when auxiliary collecting means 40 becomes full and operator merely turns off motor 12 and then disconnects flexible tubes 44 and 36 from reservoir 40 at the couplings 84 and 86. The flexible tubes 44 and 36 can then be connected together at coupling 84 and 86 and motor 12 restarted so that the operator can continue the carpet cleaning operation while his helper wheels auxiliary frame means 100 to the disposal location where it can be tilted and dumped.

As an alternative when auxiliary collecting means 40 becomes full it can be removed and immediately replaced with an identical spare collecting means so that the carpet cleaning operation can continue while the full reservoir is being emptied.

Reference is made to FIGS. 1 and 3 through 5 which illustrate a portable hot water supply system indicated generally at 170. Such system includes the previously mentioned hot water heater 172 shown in the schematic view of FIG. 2 with such heater being mounted on transverse frame members 186 and 188. Heater 172 is connected to a gaseous fuel cylinder 176, the latter being mounted on a foot portion 180 of the frame. The hot water supply system further includes spaced wheels 174 whereby it can be wheeled about, an inlet connectable to a cold water supply 164, and an outlet connectable with hot water line 130 leading to valve 140 as shown in FIG. 2.

While the form of embodiment herein shown and described constitutes preferred forms, it is to be understood that other forms might be adopted falling within the scope of the claims that follows:

What is claimed is:

1. A carpet cleaning machine comprising, in combination, wheeled frame means; a dirty fluid collecting means on the upper portion of said frame means and including a collecting means inlet and outlet; blower means mounted on said frame means and including a blower inlet communicating with said outlet of said dirty fluid collecting means and a blower outlet communicating with the enviroment; a manually manipulatable carpet cleaning tool including a tool outlet for dispensing cleaning fluid and a tool inlet for collecting dirty fluid from the carpet; passage means for delivering said dirty fluid from said tool inlet to said collecting means; means forming a source of hot water; a cleaning fluid reservoir for holding a supply of cleaning fluid; holding tank means for holding a solution of cleaning fluid and hot water mounted on said frame means and including a holding tank inlet and a holding tank outlet; first conduit means connecting said holding tank means inlet with said source of hot water for delivering a flow of hot water to said holding tank means inlet; second conduit means for delivering cleaning fluid from said reservoir to said holding tank means inlet; valve means interposed in both said first and second conduit means for simultaneously controlling a flow of cleaning fluid and a flow of hot water to said holding tank inlet to thereby form said solution in said holding tank means; and automatic valve actuator for opening said valve means upon attainment of a predetermined lower level of solution in said holding tank means, and for closing said valve means upon attainment of a predetermined upper level of solution in said holding tank means; pump means including a pump inlet communicating with said holding tank outlet and a pump outlet; a flexible cleaing fluid conduit connecting said tool outlet with said outlet of said pump means; and motor means mounted on said frame means for driving said pump means and blower means.

2. The carpet cleaning machine defined in claim 1 wherein said valve means comprises a venturi restriction in the flow of hot water to said holding tank inlet for drawing cleaning fluid from said cleaning fluid reservoir responsive to the flow of hot water through said venturi.

3. The carpet cleaning machine defined in claim 1 wherein said automatic valve actuator includes a float disposed in the liquid in said holding tank means.

4. A carpet cleaning machine comprising, in combination, wheeled frame means; a dirty fluid collecting means on the upper portion of said frame means; a dirty fluid collecting means on the upper portion of said frame means and including a collecting means inlet and outlet; blower means mounted on said frame means and including a blower inlet communicating with said outlet of said dirty fluid collecting means and a blower outlet communicating with the enviroment; a manually manipulatable carpet cleaning tool including a tool outlet for dispensing cleaning fluid and a tool inlet for collecting dirty fluid from the carpet; means forming a source of hot water; a cleaning fluid reservoir for holding a supply of cleaning fluid; holding tank means for holding a solution of cleaning fluid and hot water mounted on said frame means and including a holding tank inlet and a holding tank outlet; valve means for controlling a flow of cleaning fluid and hot water to said holding tank inlet; first conduit means connecting said valve means with said source of hot water for delivering a flow of hot water to said valve means; second conduit means for delivering cleaning fluid from said reservoir to said valve means; an automatic valve acutator for opening said valve means upon attainment of a predetermined lower level of solution in said holding tank means, and for closing said valve means upon attainment of a predetermined upper level of solution in said holding tank means pump means including a pump inlet communicating with said holding tank outlet and a pump outlet; a flexible cleaning fluid conduit connecting said tool outlet with said outlet of said pump means; motor means mounted on said frame means for driving said pump means and blower means; an auxiliary wheeled frame means for supporting an auxiliary dirty collecting means; an auxiliary dirty fluid collecting means mounted on said auxiliary frame means and including an auxiliary collecting means inlet and an auxiliary collecting means outlet; passage means for delivering said dirty fluid from said tool inlet to said auxiliary collecting means inlet; and a second passage means connecting said auxiliary collecting means outlet to said main collecting means inlet, said first and second passage means being disconnectable with respect to said auxiliary reservoir so said auxiliary reservoir can be independently transported on said wheeled frame to a dirty fluid disposal location, said first and second passage means being connectable to allow continued functioning of the apparatus by direct delivery of dirty fluid to the main dirty fluid collecting means.

5. The carpet cleaning machine defined in claim 4 wherein said valve means comprises a venturi restriction in the flow of hot water to said holding tank inlet for drawing cleaning fluid from said cleaning fluid reservoir responsive to the flow of hot water through said venturi.

6. The carpet cleaning machine defined in claim 4 wherein said automatic valve actuator includes a float disposed in the liquid in said holding tank means.

7. The apparatus defined in claim 4 and including a second auxiliary wheeled frame means for supporting the source of hot water said source comprising a water heater mounted on said auxiliary frame means and including a cold water inlet and a hot water outlet; a fuel tank mounted on said auxiliary frame means for supplying fuel to said water heater; and a flexible hot water conduit connecting said hot water outlet of said water heater with said first conduit means.

8. The apparatus defined in claim 1 and including an auxiliary wheeled frame means for supporting the source of hot water said source comprising a water heater mounted on said auxiliary frame means and including a cold water inlet and a hot water outlet; a fuel tank mounted on said auxiliary frame means for supplying fuel to said water heater; and a flexible hot water conduit connecting said hot water outlet of said water heater with said first conduit means.

* * * * *